US010690002B2

(12) United States Patent
Revak

(10) Patent No.: US 10,690,002 B2
(45) Date of Patent: Jun. 23, 2020

(54) TURBINE OVERSPEED TRIP TEST SYSTEM

(71) Applicant: Thomas Revak, LaPorte, TX (US)

(72) Inventor: Thomas Revak, LaPorte, TX (US)

( * ) Notice: Subject to any disclaimer, the term of this patent is extended or adjusted under 35 U.S.C. 154(b) by 78 days.

(21) Appl. No.: 16/037,965

(22) Filed: Jul. 17, 2018

(65) Prior Publication Data

US 2018/0328222 A1 Nov. 15, 2018

Related U.S. Application Data

(63) Continuation-in-part of application No. 14/603,161, filed on Jan. 22, 2015, now Pat. No. 10,054,004.

(60) Provisional application No. 61/930,183, filed on Jan. 22, 2014.

(51) Int. Cl.

| | |
|---|---|
| ***F01D 21/20*** | (2006.01) |
| ***F01D 21/00*** | (2006.01) |
| ***F01D 21/02*** | (2006.01) |

(52) U.S. Cl.

CPC ..... *F01D 21/003* (2013.01); *F01D 21/02* (2013.01); *F01D 21/20* (2013.01); *F05D 2220/30* (2013.01); *F05D 2260/83* (2013.01); *F05D 2270/304* (2013.01)

(58) Field of Classification Search

CPC ..... F01D 21/003; F01D 21/02; F01D 21/16; F01D 21/20; F05D 2220/31

USPC .... 60/39.24, 646, 647, 657, 660; 73/112.01, 73/112.02; 415/30; 290/40 A

See application file for complete search history.

(56) References Cited

U.S. PATENT DOCUMENTS

| | | | | |
|---|---|---|---|---|
| 3,643,437 | A | 2/1972 | Birnbaum et al. | |
| 3,928,976 | A | 12/1975 | Braytenbah et al. | |
| 4,031,466 | A | 6/1977 | Krause et al. | |
| 4,246,491 | A | 1/1981 | Waldron et al. | |
| 5,133,189 | A * | 7/1992 | Hurley | F01D 21/20 60/646 |
| 6,075,685 | A | 6/2000 | Reed et al. | |
| 2002/0107868 | A1* | 8/2002 | Childs | G05B 19/4184 |
| 2007/0138420 | A1 | 6/2007 | Shindo | |
| 2012/0151922 | A1* | 6/2012 | Koller | F01D 21/02 60/646 |

* cited by examiner

*Primary Examiner* — Leslie J Evanisko
(74) *Attorney, Agent, or Firm* — David McEwing

(57) ABSTRACT

A turbine overspeed trip test data system is a portable system by which an operator can electronically gather and log data during a turbine overspeed test. A plurality of sensors can be affixed to various components of the turbine for gathering test data to be received by a processing unit to assess the operation of the turbine overspeed trip protection components. The test data may be compiled into a turbine test log. A method for processing the gathered sensor data is also provided.

17 Claims, 9 Drawing Sheets

TURBINE OVERSPEED TRIP TEST SYSTEM

RELATED U.S. PATENT DOCUMENTS

This Application is a Continuation in Part of pending application Ser. No. 14/603,161 filed Jan. 22, 2015 and entitled Turbine Overspeed Trip Test Data Logging System. The Application claims priority to provisional application 61/930,183 filed Jan. 22, 2014 and entitled Turbine Overspeed Trip Test Data Logging System. Both applications, as amended, are hereby incorporated herein by reference in their entirety.

FIELD OF THE INVENTION

The present invention relates generally to a turbine overspeed trip test system and method of use. More specifically, the present invention is a system to allow routine testing and documentation of turbine overspeed trip protection systems that includes measurement and recording of the operation of turbine overspeed protection system components: shaft speed sensing component, i.e., turbine rotor rotational speed component (hereinafter "rotor speed" or "rotor shaft speed"), overspeed sensing component and the movement of the stop valve or valves.

BACKGROUND OF THE INVENTION

Every steam or gas turbine installed in the world has a system to protect it from a destructive overspeed event. If the turbine speed reaches beyond a certain level, different for each machine depending on its design, major mechanical failure will occur. Although there are many different designs and configurations for the overspeed trip protection system, every one of them is designed to sense when the rotor shaft speed reaches a predetermined speed limit and then activate a shutdown system to protect the turbine from damage.

The simplest and most common protection systems consist of a mechanical device mounted on the shaft of the rotor (hereinafter "rotor shaft") that moves when the speed limit is reached. The mechanical device then strikes a stationary mechanism that is linked to a valve. The interaction of the overspeed device and the mechanical linkage results in the rapid closing of a steam or gas shut-off or "trip valve". Closure of the shut-off valve causes the rotor shaft to stop.

Systems can range from the simplest mechanical designs, as described above, to very sophisticated electronic detection and valve actuation systems with very rapid response times. Whether simple or complex, however, the systems need to be tested from time to time to verify proper operation.

In addition to simply verifying that the system functions, it is also important to measure the response time of the system turbine overspeed protection components and document all of the results. When a turbine is equipped with an electronic control system and that control system is integrated into an overall computerized plant control system then it is possible to perform an overspeed test and record the rotor speed history during the test. However, the plant control system only measures and stores rotor speed versus time and does not measure or record anything else.

There is no system known to this writer which is designed to allow the operator to measure anything more than rotor shaft speed when they are testing an overspeed trip detection system. The "state of the art" for conducting overspeed trip system tests is to visually monitor speed and either watch or listen for the sudden closing of the stop valve. The operator must visually and mentally associate a speed of the value with the moment the trip system activates. This is true even for a system that records rotor speed as described above.

It is therefore an object of the present invention to allow routine testing and documentation of turbine overspeed trip systems that includes measurement and recording of at least two of the system components: rotor shaft speed, the activation of the overspeed sensing device and the movement of the stop valve or valves.

BRIEF DESCRIPTION OF THE DRAWINGS

The accompanying drawings, which are incorporated in and constitute a part of the specification, illustrate preferred embodiments of the disclosure. These drawings, together with the general description given above and the detailed description of the preferred embodiments given below, serve to explain the principles of the system and method.

DETAIL DESCRIPTIONS OF THE DISCLOSURE

Figure 1:
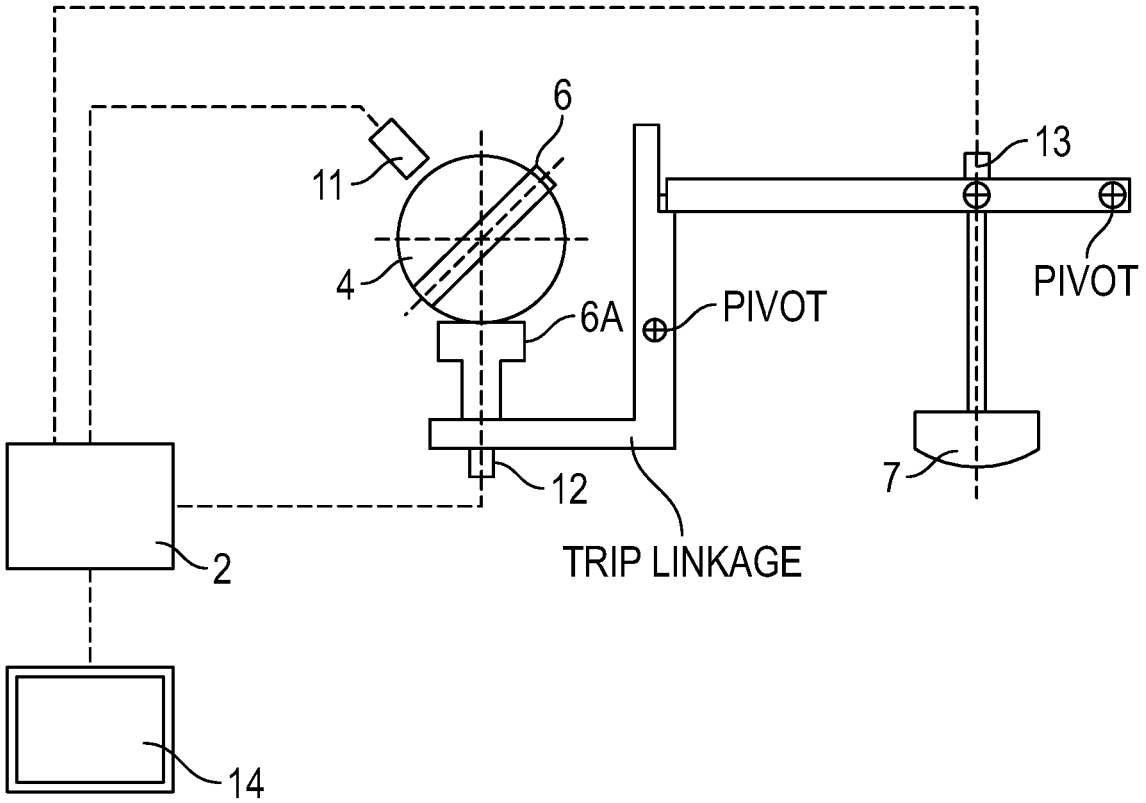
FIG. 1 is a schematic diagram of the present disclosure in use with a turbine with a mechanical overspeed protection system.
Figure 2:
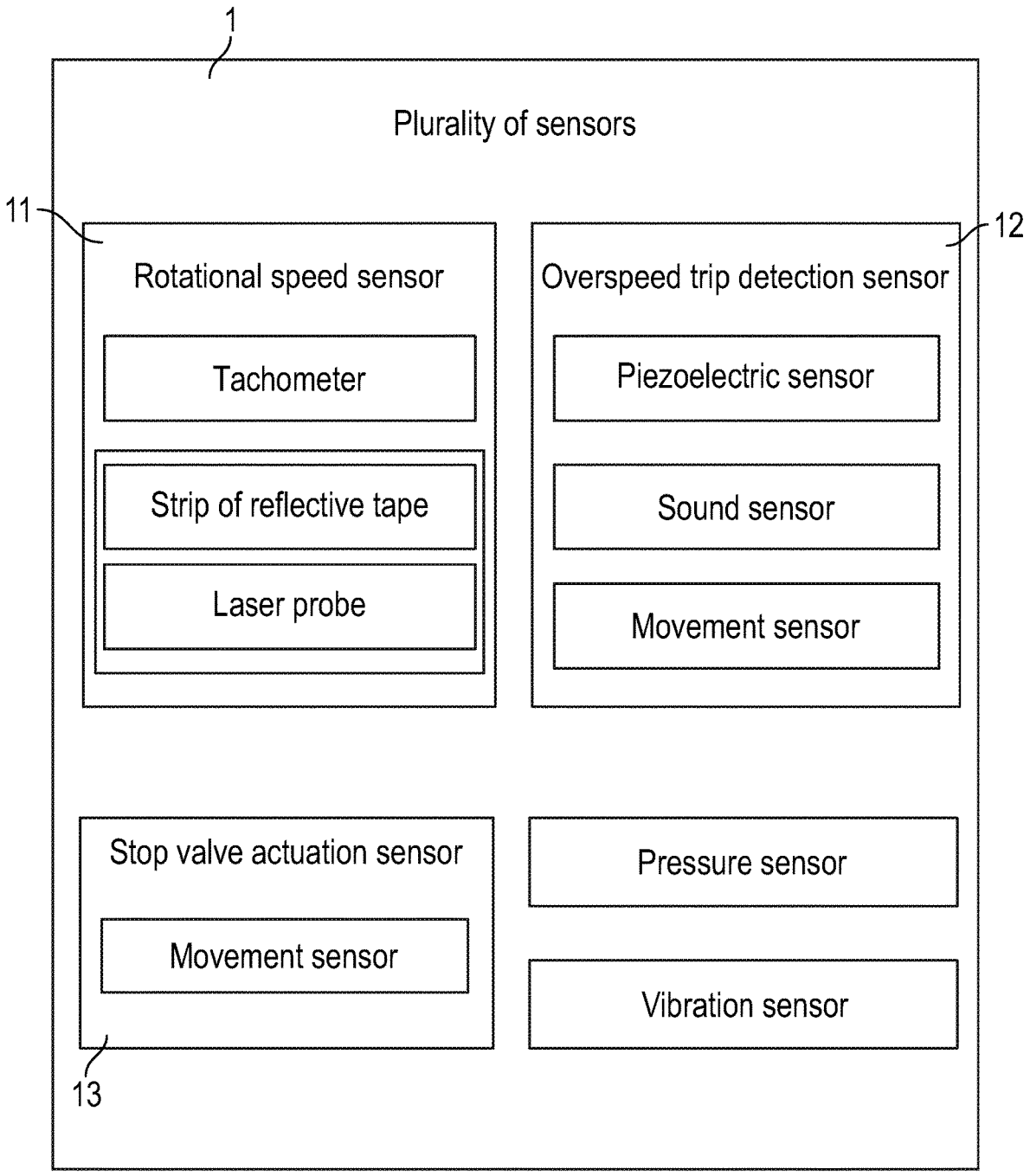
FIG. 2 is a block diagram of the electrical components of the present invention and various possible sensor types to be used.
Figure 3:
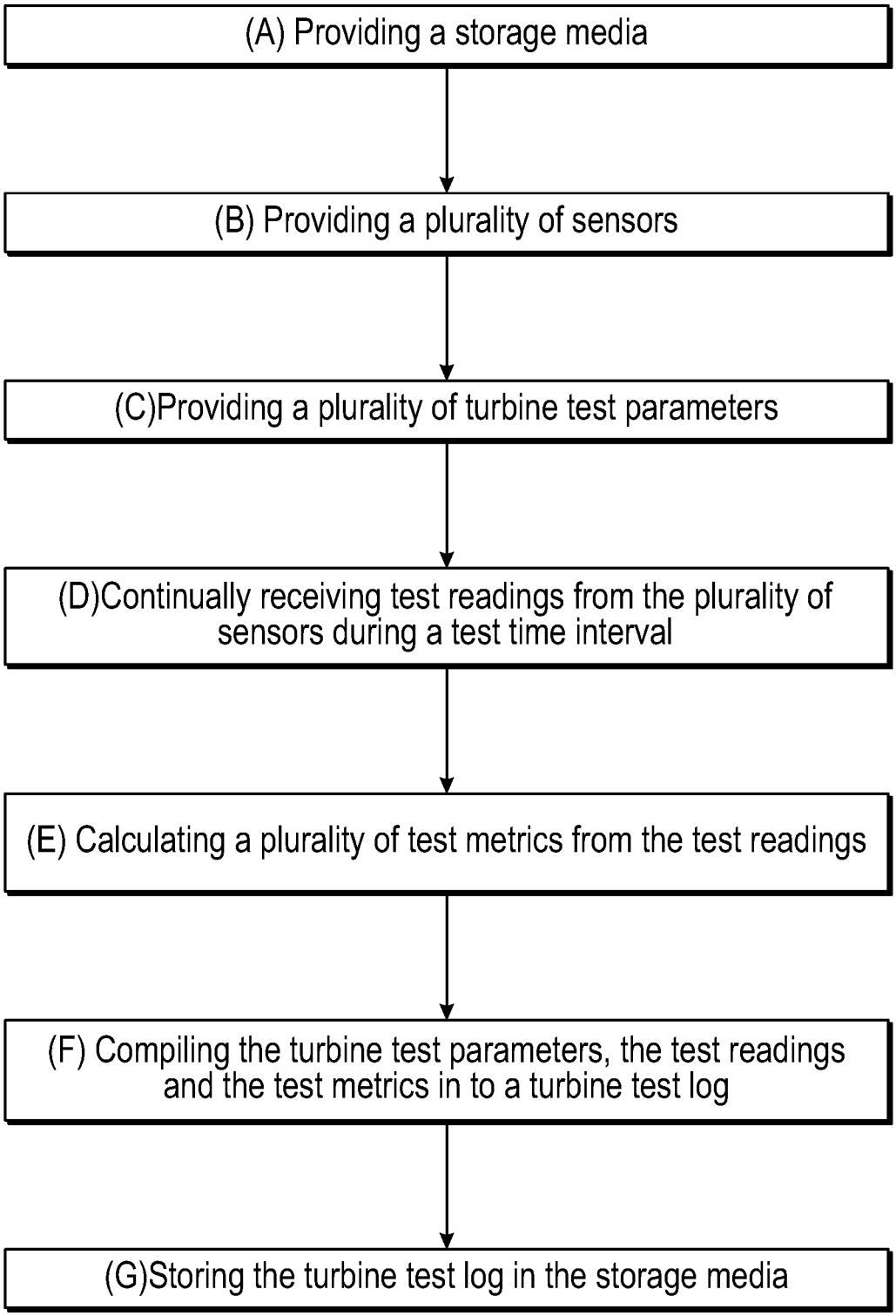
FIG. 3 is a stepwise flow diagram describing the general process of using the present invention.
Figure 4:
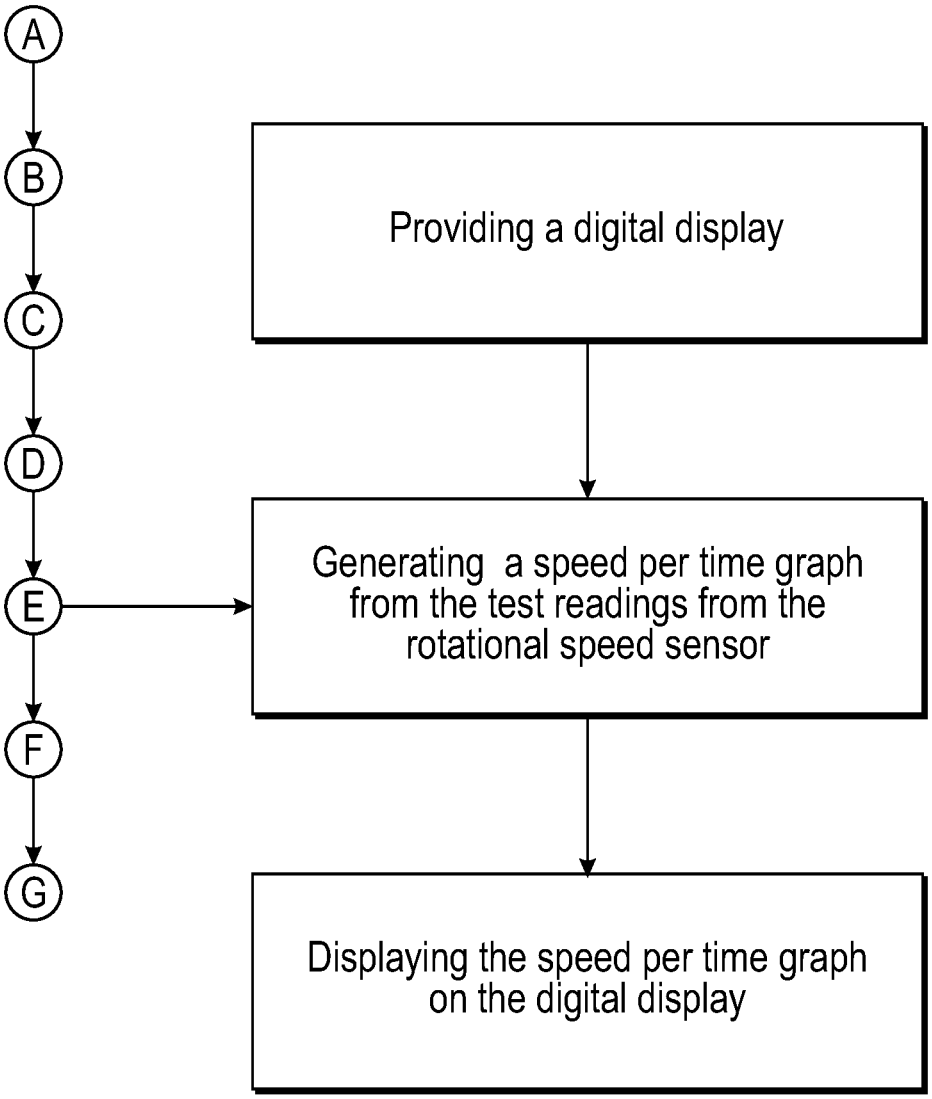
FIG. 4 is a stepwise flow diagram describing the process for processing and displaying speed per time sensor inputs.
Figure 5:
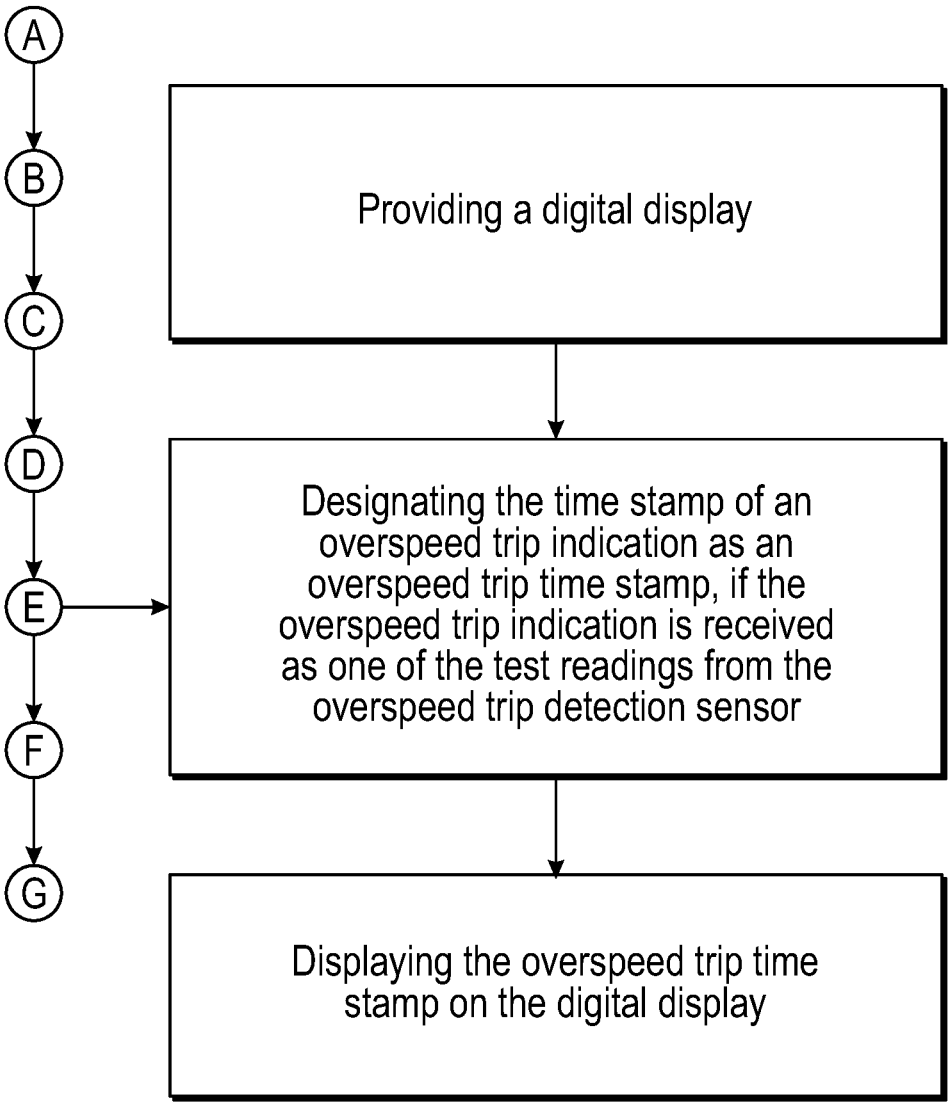
FIG. 5 is a stepwise flow diagram describing the process for processing and displaying an overspeed trip indication.
Figure 6:
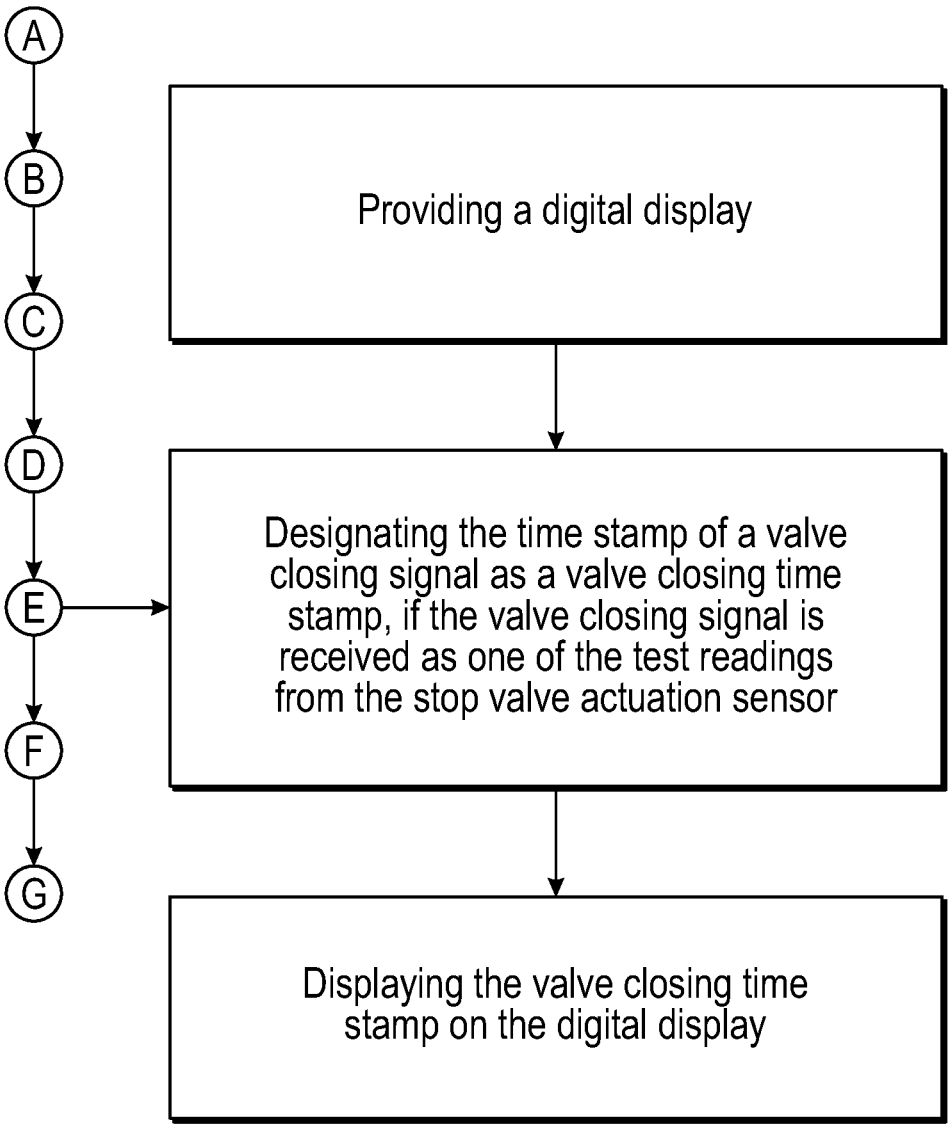
FIG. 6 is a stepwise flow diagram describing the process for processing and displaying a valve closing signal.
Figure 7:
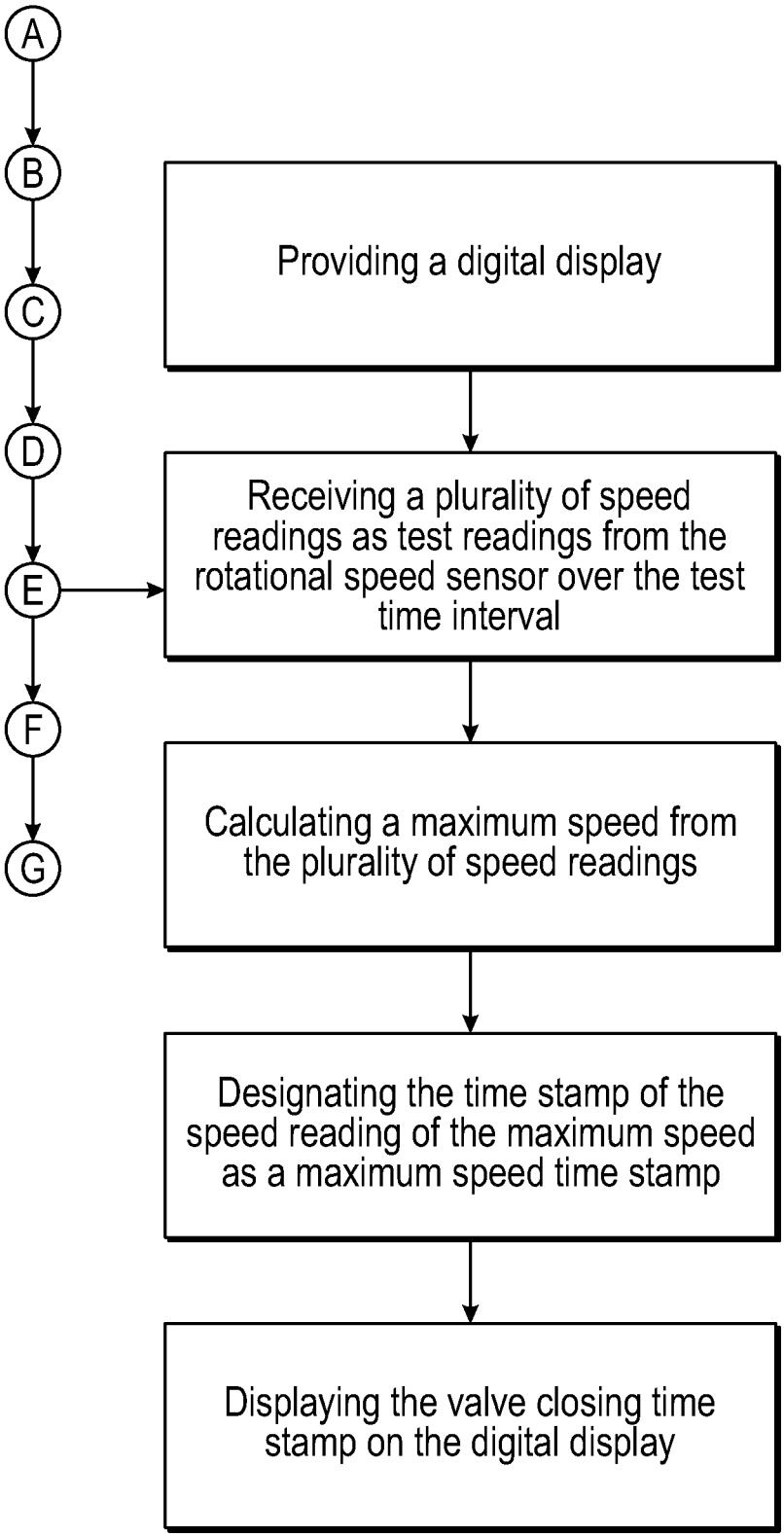
FIG. 7 is a stepwise flow diagram describing the process for processing and displaying a maximum speed for the overspeed test.
Figure 8:
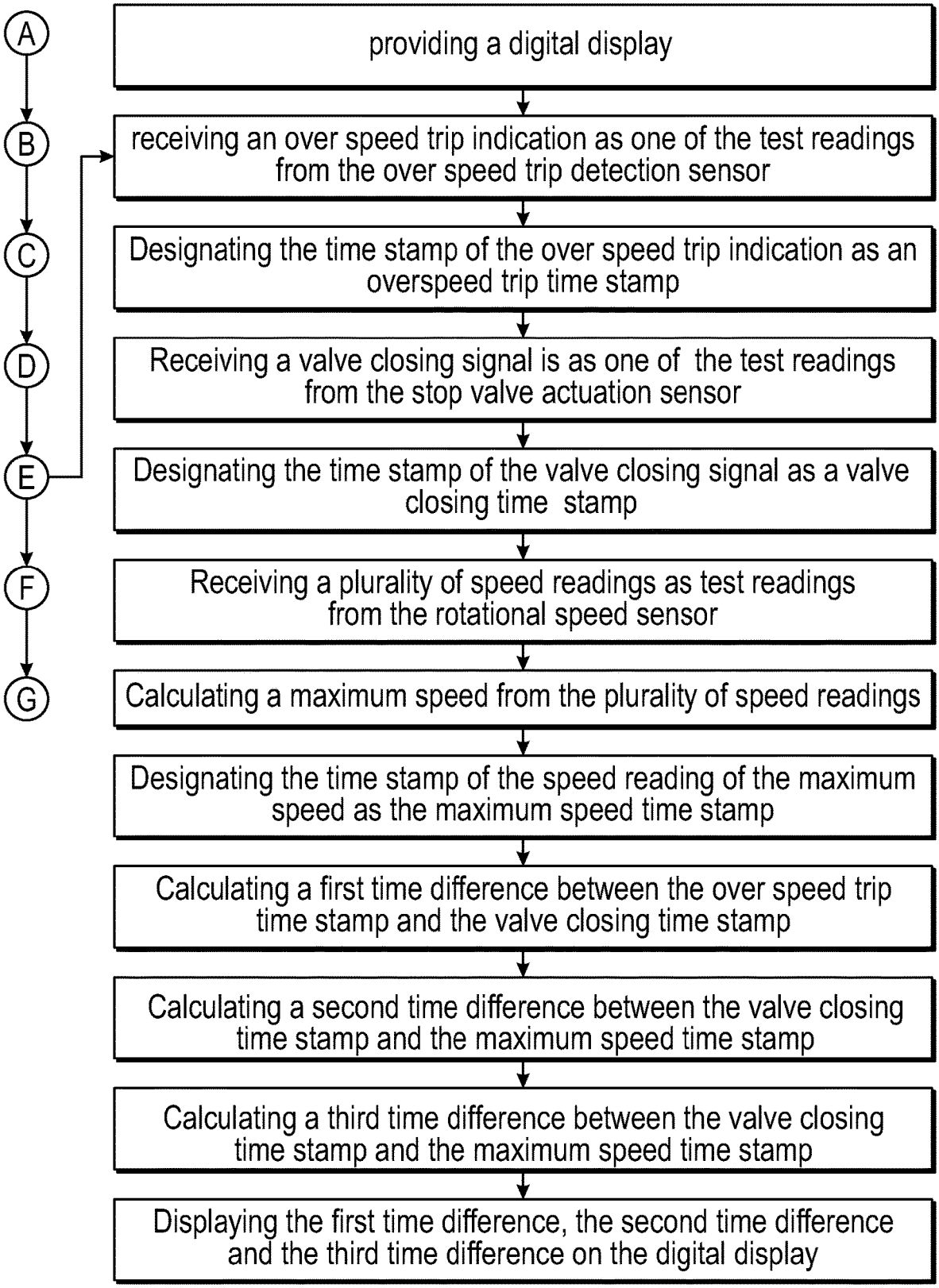
FIG. 8 is a stepwise flow diagram describing the process for processing and displaying several time intervals for the overspeed test.

All illustrations of the drawings are for the purpose of describing selected versions of the present disclosure and are not intended to limit the scope of the present system or method. The present system and method is to be described in detail and is provided in a manner that establishes a thorough understanding of the present disclosure. There may be aspects of the present disclosure that may be practiced without the implementation of some features as they are described. It should be understood that some details have not been described in detail in order to not unnecessarily obscure focus of the disclosure.

The purpose of the Turbine Overspeed Trip Test System (hereinafter the "overspeed trip test system") is to allow routine testing or documentation of turbine overspeed trip protection systems, including measurement and recording (e.g., time stamping) system components: rotor shaft speed, the overspeed detection components 6 and the movement of the stop valve 7 or valves, including non-return valves 18 or control valves 20. Documentation may be referred to a "data" or "readings". Recording may be storing the data on a computer-readable medium. The storage may be temporary (transitory) or non-transitory.

In one embodiment, the rotor shaft speed is measured and the time that the rotor shaft speed exceeds a specified parameter or speed, a rotational overspeed event may be time stamped. This event is detected by a sensor 11 at the rotor shaft 4. The time that the turbine overspeed trip sensing component 6 detects the rotational overspeed event is also time stamped. This is the overspeed trip event or "overspeed trip". The system component 12 marks the time of the activation of the turbine's overspeed protection system 6. The times can be compared and the performance of the system can be assessed. It will be appreciated that it is an advantage (for safety and turbine maintenance) that the time between the rotor shaft reaching a predetermine maximum rotation speed and detection by the turbine system controls be minimized. This is particularly important for turbines utilizing mechanical control mechanisms. The turbine rotor shaft may continue or increase in speed rotation until the turbine overspeed stop trip valve is closed, thereby shutting off power to the rotor.

In another embodiment, the system measures turbine rotor shaft speed 4, records the time that the rotor shaft speed exceeds the predetermined turbine rotor shaft speed (specified parameter), and records the time that the turbine trip stop valve 7 begins to close. In another embodiment, the system records the time that the turbine trip stop valve closure is complete.

It will be further appreciated that the Turbine Overspeed Trip Test System does not control the rotor shaft speed, nor activate either the overspeed detection system component or the overspeed stop trip valve.

The system will primarily be targeted at the market utilizing simple steam turbines with purely mechanical trip systems and no means of recording speed. It can be adapted, using different sensors, to a turbine with electronic controls so that the existing electronic data can be incorporated into the test system data. The preferred embodiment of the present invention is as a portable kit which can be transported to any given turbine installation location for use. The present invention utilizes a number of sensors, a data processing unit 2, and software for recording and processing data from the sensors in order to create digital logs and documentation for turbine overspeed tests.

In the preferred embodiment, the present invention comprises a plurality of sensors 1, a processing unit 2, and a data storage unit 3. The apparatus of the present invention may be transported in a hard shell enclosure for convenience. In the preferred embodiment, the plurality of sensors 1 comprises a rotational speed sensor 11, an overspeed trip detection sensor 12, and a stop valve actuation sensor 13. The rotational rotor speed sensor 11 measures the rotational speed of a rotor shaft 4 of the turbine to be tested. The overspeed trip detection sensor 12 detects an overspeed condition trip of the turbine, which is prompted by an overspeed detection system 6 of the turbine. That is, upon detection of an overspeed condition, the overspeed detection system 6 causes an overspeed condition trip in order to shut down the turbine. Shut down may be achieved by activating the stop valve to close, thereby stopping the turbine. The stop valve actuation sensor 13 detects movement of a stop valve 7, which plugs a steam line or gas line in order to cut off input to the turbine. The movement of the stop valve 7 is triggered by the overspeed condition trip. The plurality of sensors 1 and the data storage unit 3 are electronically connected to the processing unit 2.

It is common for overspeed detection systems to utilize a mechanical device to detect an overspeed condition. In this case, a hollow shaft oriented laterally to the axis of the turbine shaft 4 within the turbine shaft 4 contains a pin affixed to a spring. As the turbine shaft 4 spins faster, the pin experiences centrifugal inertia of motion, causing the pin to move further toward the exterior of the turbine shaft 4. At a certain threshold speed calibrated by the tension of the spring, the pin protrudes from the body of the turbine shaft 4 and strikes a trip linkage, which in turn causes the stop valve 7 to close and prevent any further steam or gas from entering the turbine, effectively shutting the turbine down. While this is one way an overspeed detection system 6 can function, there are many other means for accomplishing the same goal. In this case, the pin striking the trip linkage or trip linkage striker functions as an overspeed trip actuation device 6A. In other systems, other overspeed trip actuation device 6 may be used, to which the present invention may be adapted.

To utilize the present invention, in its preferred embodiment, to perform a turbine overspeed test, each of the plurality of sensors 1 is affixed to one of various components of the turbine and the overspeed protection system 6 of the turbine. In one embodiment of the present invention, the rotational speed sensor 11 is affixed directly to the turbine shaft 4. In this embodiment, the rotational speed sensor 11 comprises a strip of reflective tape and a laser probe. The strip of reflective tape is affixed to the turbine shaft 4, and the strip of reflective tape is read by the laser probe as the turbine rotates in order to measure the rotational speed of the turbine shaft 4. In another embodiment, the rotational speed sensor 11 is a tachometer that is pre-installed and already comprised by the turbine. The processing unit 2 may connect to the tachometer in order to receive data input from the tachometer. In this case, the present invention should additionally comprise an appropriate connection component such as a connector cable, wire or wireless communication (WiFi) component in order to interface with the computer system associated with the turbine or with the tachometer itself. Other types of rotational speed sensors may be used as useful or appropriate, including, but not limited to, magnetic rotational speed sensor, electrical rotational speed sensors, frictional rotational speed sensors, or other rotational speed sensors.

It will be appreciated that wireless communication (WiFi) is based on the IEEE 802.11 standards and utilizing radio waves to provide wireless high-speed Internet and network connections between a processing unit and one or more sensors subject of this disclosure.

In several of the embodiments, the overspeed trip test sensor 12 is removably affixed to the overspeed trip actuation device 6 of the overspeed protection system 1. Alternatively, the overspeed trip detection sensor 12 is removably affixed near the overspeed trip actuation device 6 or to a secondary linkage or device actuated by the overspeed trip actuation device 6, if that is sufficient to acquire sensor readings or required depending on the construction of the overspeed protection system 6. In the preferred embodiment of the present invention, the overspeed trip test-sensor 12 is a piezoelectric sensor. The overspeed trip detection sensor 12 may be a sound sensor or a movement sensor as appropriate for the application. The overspeed trip test sensor 12 is not limited to a piezoelectric sensor, however. Detection of the overspeed condition trip may conceivably be done in a variety of ways, and thus the overspeed trip test sensor may belong to one of a number of sensor types, including, but not limited to: voltage measurement of the current through an electrical solenoid valve, inertia switches, magnetic sensors, friction sensors, or optical sensors.

In several of the embodiments, the stop valve actuation sensor 13 is removably affixed to the stop valve 7 of the overspeed protection system. Similar to the overspeed trip test sensor 12, the stop valve actuation sensor 13 may be removably affixed near the stop valve 7 or to a linkage connected to the stop valve 7 as appropriate, useful or necessary depending on the design of the turbine and/or the overspeed protection system 6.

In the preferred embodiment, the stop valve actuation sensor 13 is a movement sensor that detects either when the stop valve 7 begins moving, ends moving, or both. However, similar to the overspeed trip test sensor 12, the stop valve actuation sensor 13 may belong to any class or type of sensor that facilitates detection of the stop valve 7 closing. For example, the sensor may be a piezoelectric sensor, a sound sensor or a movement sensor as appropriate for the application. The stop valve actuation sensor 13 may also be one of a number of sensor types, including, but not limited to: voltage measurement of the current through an electrical solenoid valve, inertia switches, magnetic sensors, friction sensors, or optical sensors.

The plurality of sensors 1 of the present invention is not limited to the rotational rotor speed sensor 11, the overspeed trip detection sensor 12 and the stop valve actuation sensor 13. Potentially, any other sensors which can provide valuable data for a turbine overspeed test may be additionally comprised by the plurality of sensors 1. One such additional sensor is a pressure sensor. The purpose of the pressure sensor is to monitor the pressure of steam or gas input to the turbine, which is another variable which can be valuable for operational testing of a turbine. The pressure sensor may either be removably placed within a steam line of the turbine, or the pressure sensor may be a pre-installed component with which the present invention may interface, similar to the tachometer. Additionally, the plurality of sensors 1 may also comprise a vibration sensor which is removably attached to the turbine. The vibration sensor may be any useful sensor for detecting vibration of the turbine shaft 4 such as, but not limited to, an accelerometer, a sound vibration sensor, or another type of vibration sensor. Vibration of the turbine shaft 4 is desirable to measure in order to ascertain whether the turbine shaft 4 has any rotational imbalances which could lead to undesirable wear or damage to the turbine.

It should be noted that more than one individual sensor and/or sensor component may be utilized for each of the rotational speed sensor 11, the overspeed trip test sensor 12, the stop valve actuation sensor 13, or any additional sensors for measuring various other relevant variable, and each of said sensor is not necessarily limited to a single sensor or sensor type.

Figure 9:
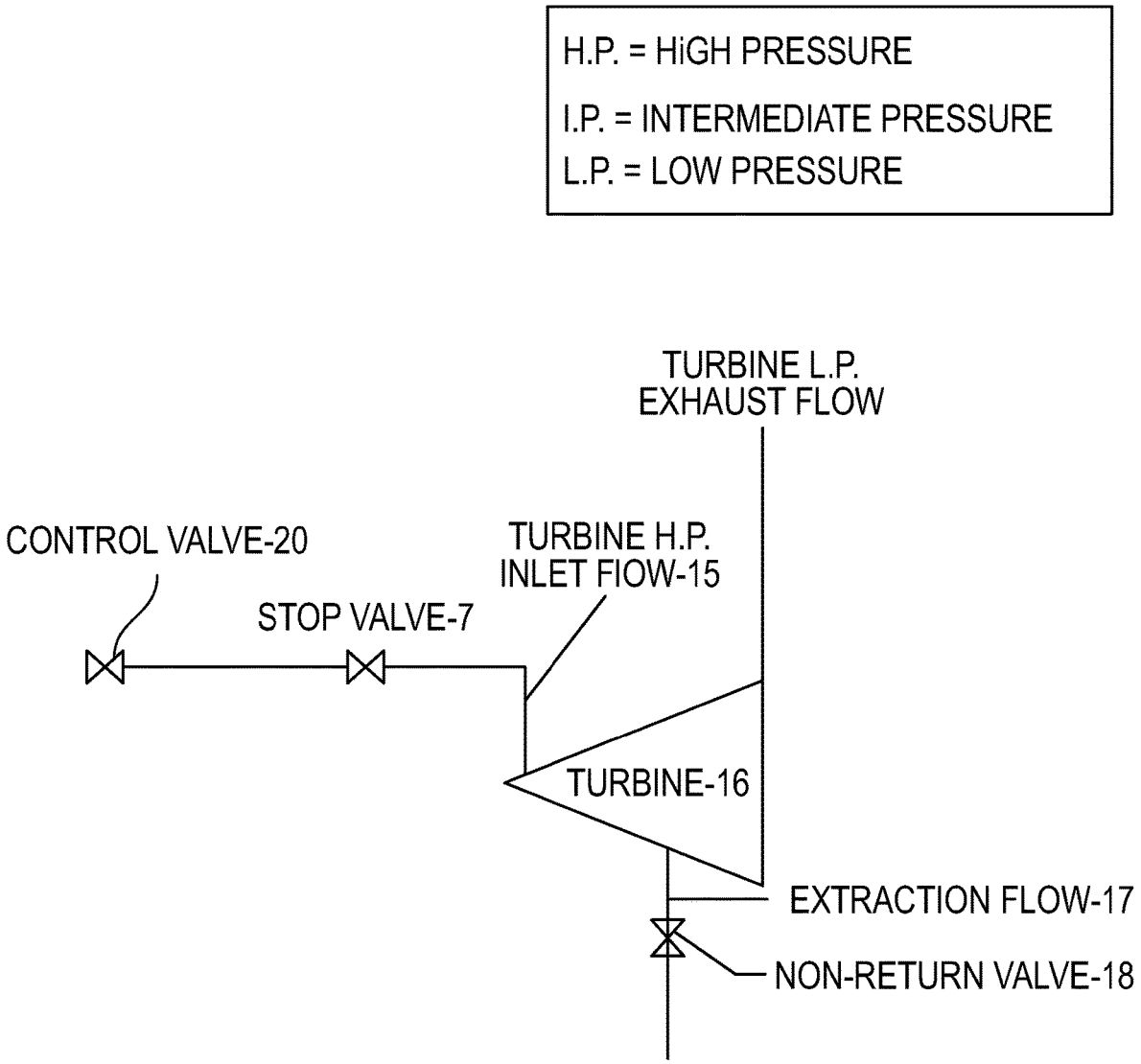
FIG. 9 is a schematic drawing of on embodiment of the location of a non-return valve and control valve in relation to the stop valve.

Some turbines also include or utilize a non-return valve 18. See FIG. 9. This valve typically operates in conjunction with the stop valve 7 discussed above. The non-return valve can operate as a check valve. It will be appreciated that fluid 15 enters the turbine 16 at a high pressure. The fluid pressure decreases as it progresses through the turbine. in some large turbines, it is possible to bleed off some of the reduced pressure inlet flow 17 to power an intermediate pressure system. In an overspeed trip event, it is the high fluid pressure inlet flow that is to be closed by operation of the stop valve. In the event that the supply of high pressure fluid is stopped, the pressure within the turbine drops. Fluid in the Intermediate pressure system may accordingly reverse direction to flow back into the turbine (now at low fluid pressure). The intermediate pressure fluid may push fluid back into the turbine which would freely flow to the turbine exhaust and generate power (thereby to cause continued rotation of the turbine). The non-return valve 18 positioned outside of the turbine as part of the intermediate pressure fluid system prevents this secondary intermediate pressure fluid flow to return into the turbine. In this manner, the non-return valve operates as a one way or check valve. The timing of the closure of this non-return valve may also be monitored or recorded by the disclosure The flow of high pressure fluid into a turbine is controlled by a control valve or governing valve 20. In most configurations, this control valve precedes the stop valve 7. In the event of an overspeed trip event, signals can be sent to both the control valve and stop valve directing that the valves to close. Therefore, in one embodiment of this disclosure, the overspeed trip event test system may measure the time that the control valve begins to close, as well as the time that the stop valve begins to close.

In addition to the physical apparatus, the present invention includes a method for utilizing the turbine overspeed trip test system. The method is preferably a software program or multiple software programs which function together or in separate steps in order to adequately collect and process data from the plurality of sensors 1. The method may include storing the processed data. The stored data may be used to create a log or table of test data. The processing of the data may include the determining of the respective time at the occurrences of the several method steps. For example, a time lag between the overspeed trip event (i.e., rotor shaft speed exceeding the predetermined limit) and the closure of the stop shut valve.

In an embodiment of the method of the present invention, a non-transitory computer storage media and the plurality of sensors 1 are provided, in addition to a plurality of turbine test parameters. The plurality of turbine test parameters comprises, but is not limited to, a normal operating speed, a designated overspeed trip speed, a maximum allowable speed, a test date, a test operator identification, and a turbine identification. The test parameters may comprise the log of test data, i.e., a turbine overspeed trip test data log. The designated overspeed trip speed is the speed at which the overspeed detection system 6 is designed to recognize (i.e., detect) an overspeed condition of the turbine. Each of the plurality of turbine test parameters are predefined and input into the software for each turbine overspeed test as part of a turbine test log.

In one embodiment of the method, a plurality of test readings (data) may be continually received from the plurality of sensors 1 during a test time interval, with each of the test readings being associated with a time stamp. The data may be stored or recorded in a computer-readable medium such as computer bus, RAM, ROM or memory. The time at which any given sensor reading is taken should be able to be identified for evaluation and logging purposes. A plurality of test metrics is calculated from the test readings. In the preferred embodiment, the turbine test parameters, the test readings, and the test metrics are compiled into a turbine test log, and the turbine test log is stored in the non-transitory storage media.

In order to review the turbine test log, a display 14 is provided. The processing unit 2 and/or storage media, whatever form they take, is electronically connected to the display. Each of the test metrics is displayed on the display alongside any appropriate labeling for documentation purposes.

One of the test metrics is a speed per time graph. The speed per time graph is generated from the test reading from the rotational speed sensor 11. The graph shows the rotor speed at specified times. In one embodiment, the test metric is the time that the rotor speed reaches a designated overspeed trip speed. The speed per time graph may be displayed on a display.

Another test metric is an overspeed trip indication. The time stamp of the overspeed trip indication is designated as an overspeed trip time stamp if the overspeed trip indication data is received as one of the test readings from the overspeed trip detection sensor 12. Upon viewing the data, the overspeed trip time stamp is displayed on the display. Another test metric is a valve closing time stamp. If a valve closing signal data is received as one of the test readings from the stop valve actuation sensor 13, the time stamp of the valve closing signal is designated as a valve closing time stamp. The valve closing time stamp is subsequently displayed on the display. The valve closing time stamp may be part of a turbine test log.

Another of the test metrics is a maximum speed. A plurality of speed readings is received as test readings from the rotational speed sensor 11 over the test time interval, wherein each of the plurality of speed readings is a rotational speed of the turbine rotor shaft 4 at an associated point in time. The maximum speed is calculated from the plurality of speed readings, and the time stamp of the speed reading of the maximum speed is designated as the maximum speed time stamp. The maximum speed may be calculated from the plurality of speed readings by any useful algorithm for finding the maximum value from a plurality of values.

It is also desirable to collect other data and calculate several other time intervals for the turbine test log. Such time intervals include, but are not limited to, the time between the overspeed trip, i.e., rotor shaft speed exceeding the imputed speed limitation parameter, and the stop valve 7 closing, the time between the stop valve 7 closing and the maximum speed achieved by the rotor shaft, and the time between the overspeed trip and the maximum speed. To this end, a first time difference is calculated between the overspeed trip time stamp and the valve closing time stamp. It will be appreciated that the valve closing time stamp may be the time that the sensor detects movement of the turbine stop close valve. Alternatively, the valve closing time stamp may be the time that the sensor detects the valve closure has been completed.

Similarly, a second time difference is calculated between the valve closing time stamp and the maximum speed time stamp, and a third time difference is calculated between the overspeed trip time stamp and the maximum speed time stamp. The first time difference, the second time difference, and the third time difference may be displayed on the display. This display may be part of a turbine test log. Another desirable time interval to calculate may include but is not limited to a time difference between when the stop valve 7 begins to close and when the stop valve 7 finishes closing, in order to more precisely evaluate the overspeed trip detection system.

Although the disclosure has been explained in relation to its preferred embodiment, it is to be understood that many other possible modifications and variations can be made without departing from the spirit and scope of the disclosure as hereinafter claimed.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention maybe utilized independently of the use of other features, all as would be apparent to one skilled in the art after having the benefit of this description of the invention.

While specific embodiments have been illustrated and described, numerous modifications are possible without departing from the spirit of the invention, and the scope of protection is only limited by the scope of the accompanying claims.

What I claim is:

1. A turbine overspeed trip test device that monitors turbine rotor shaft speed and turbine overspeed detection components to allow assessment of turbine overspeed protection components wherein the trip test device comprises:

(a) a plurality of sensors structured to be temporarily and removably attached to turbine components, wherein the sensors can be attached or removed before or after an overspeed trip test without disassembly of the turbine components wherein the plurality of sensors comprises:

(i) a rotational speed sensor structured to measure the rotational speed of a rotor shaft of a turbine; and (ii) an overspeed detection sensor structured to measure the time that the turbine overspeed protection components detect a turbine rotor shaft overspeed condition trip event;

(b) communication components attached to each sensor for communication between each sensor and a processing unit; and (c) the processing unit comprising a component for time stamping at least some data received from the sensors and further comprising (i) structure and configuration to receive and process data from each of the plurality of sensors, and (ii) that computes the difference in time between the detection of an overspeed event by the rotational speed sensor and detection of an overspeed condition trip by the overspeed detection sensor.

2. The turbine overspeed trip test device of claim 1 wherein the processing unit comprises a display component.

3. The turbine overspeed trip test device of claim 1 wherein the processing unit further comprises a data storage component.

4. The turbine overspeed trip test device of claim 1 wherein each sensor is configured to communicate with the processing unit by electrical or radio signal.

5. The turbine overspeed trip test device of claim 1 further comprises the processing unit creating a turbine test log.

6. The turbine overspeed trip test device of claim 1 further comprising the rotational speed sensor structured to measure rotational speed utilizing turbine speed measurement components.

7. The turbine overspeed trip test device of claim 1 wherein the rotational speed sensor utilizes data of a turbine rotor shaft tachometer.

8. A turbine overspeed trip test device that monitors turbine rotor shaft speed and turbine overspeed detection components to allow assessment of turbine overspeed protection components wherein the trip test device comprises:

(a) a plurality of sensors structured to be temporarily and removably attached to turbine components, wherein the sensors can be attached or removed before or after an overspeed trip test without disassembly of the turbine components wherein the plurality of sensors comprises:

(i) a rotational speed sensor structured to measure the rotational speed of a rotor shaft of a turbine; and (ii) a stop valve actuation sensor structured to detect a time of movement of a turbine stop valve during a stop valve closing action;

(b) communication components attached to each sensor for communication between each sensor and a processing unit; and (c) the processing unit comprising a component for time stamping at least some data from the sensors and further comprising (i) that the processing unit is structured and configured to receive and process data from each of the plurality of sensors, and (ii) that computes the difference in time between the detection of an overspeed event by the rotational speed sensor and detection of the turbine stop valve movement.

9. The turbine overspeed trip test device of claim 8 further comprising a display component.

10. The turbine overspeed trip test device of claim 8 further comprising a data storage component.

11. The turbine overspeed trip test device of claim 8 wherein each sensor is configured to communicate with the processing unit by electrical or radio signal.

12. A turbine overspeed trip test device that monitors turbine rotor shaft speed and turbine overspeed detection components to allow assessment of turbine overspeed protection components wherein the trip test device comprises:

(a) a plurality of sensors structured to be temporarily and removably attached to turbine components, wherein the sensors can be attached or removed before or after an overspeed trip test without disassembly of the turbine components wherein the plurality of sensors comprises:

(i) a rotational speed sensor structured to measure the rotational speed of a rotor shaft utilizing turbine speed measurement components; and (ii) a stop valve actuation sensor structured to detect a time of movement of a turbine stop valve during the stop valve closing action;

(b) communication components attached to each sensor for communication between each sensor and a processing unit; and (c) the processing unit comprising a component for time stamping at least some data received from the sensors data and further comprising (i) that the processing unit is structured and configured to receive and process data from each of the plurality of sensors, and (ii) that the processing unit computes the difference in time between the detection of an overspeed event by the rotational speed sensor and detection of movement of a turbine stop valve during a stop valve closing action.

13. The turbine overspeed trip test device of claim 12 wherein the rotational speed sensor utilizes data of a turbine rotor shaft tachometer.

14. The turbine overspeed trip test device of claim 12 further comprising a display component.

15. The turbine overspeed trip test device of claim 12 wherein the processing unit further comprises a data storage component.

16. The turbine overspeed trip test device of claim 12 wherein each sensor is configured to communicate with the processing unit by electrical or radio signal.

17. The turbine overspeed trip test device of claim 12 further comprises a turbine test log.

* * * * *